US006413413B1

(12) United States Patent
Smith, Jr.

(10) Patent No.: US 6,413,413 B1
(45) Date of Patent: Jul. 2, 2002

(54) HYDROGENATION PROCESS

(75) Inventor: Lawrence A. Smith, Jr., Houston, TX (US)

(73) Assignee: Catalytic Distillation Technologies, Pasadena, TX (US)

( * ) Notice: Subject to any disclaimer, the term of this patent is extended or adjusted under 35 U.S.C. 154(b) by 0 days.

(21) Appl. No.: 09/474,192

(22) Filed: Dec. 29, 1999

Related U.S. Application Data

(60) Provisional application No. 60/114,331, filed on Dec. 31, 1998.

(51) Int. Cl.[7] ..... C10G 45/02; C10G 45/32

(52) U.S. Cl. ..... 208/213; 208/217; 208/144; 208/264; 585/259

(58) Field of Search ..... 208/213, 217, 208/160, 144, 264; 203/29, 28, DIG. 6; 585/259

(56) References Cited

U.S. PATENT DOCUMENTS

| | | | | |
|---|---|---|---|---|
| 2,918,425 | A | | 12/1959 | Berger et al. |
| 3,560,167 | A | | 2/1971 | Bruckner et al. |
| 3,702,237 | A | | 11/1972 | Watkins |
| 4,126,539 | A | | 11/1978 | Derr, Jr. et al. |
| 4,171,260 | A | | 10/1979 | Farcasiu et al. |
| 4,194,964 | A | | 3/1980 | Chen et al. |
| 4,283,271 | A | | 8/1981 | Garwood et al. |
| 4,484,983 | A | * | 11/1984 | Bannon ..... 203/42 |
| 4,990,242 | A | | 2/1991 | Louie et al. |
| 5,011,593 | A | | 4/1991 | Ware et al. |
| 5,409,599 | A | | 4/1995 | Harandi |
| 5,510,568 | A | | 4/1996 | Hearn |
| 5,554,275 | A | | 9/1996 | Harandi |
| 5,597,476 | A | * | 1/1997 | Hearn et al. ..... 208/208 R |
| 5,714,640 | A | * | 2/1998 | Bell et al. ..... 568/697 |
| 5,779,883 | A | | 7/1998 | Hearn et al. |
| 5,807,477 | A | * | 9/1998 | Hearn et al. ..... 208/238 |
| 5,837,130 | A | * | 11/1998 | Crossland ..... 208/213 |
| 5,863,419 | A | * | 1/1999 | Huff, Jr. et al. ..... 208/237 |
| 5,925,685 | A | | 7/1999 | Adams et al. |
| 5,925,799 | A | * | 7/1999 | Stanley et al. ..... 585/259 |
| 5,961,815 | A | * | 10/1999 | Hickey et al. ..... 208/108 |
| 6,083,378 | A | * | 7/2000 | Gildert et al. ..... 208/209 |

FOREIGN PATENT DOCUMENTS

| | | |
|---|---|---|
| WO | WO97/40120 | 10/1997 |
| WO | WO98/38265 | 9/1998 |

OTHER PUBLICATIONS

Trickle Hydrodesulfurization, The Oil and Gas Journal, Apr. 5, 1965, p. 116.

M.L. Derrien, J.W. Andrews, P. Bonnifay, and J. Leonard, The IFP Selective Hydrogenation Process, Chemical Engineering Progress vol. 70. No. 1, Jan. 1974, pp. 74–80.

Mordechay Herskowitz, Trickle–Bed Reactors: A Review, AIChE Journal vol. 29, No. 1, Jan., 1983, pp. 1–18.

* cited by examiner

*Primary Examiner*—Bekir L. Yildirim
(74) *Attorney, Agent, or Firm*—Kenneth H. Johnson

(57) ABSTRACT

A process for hydrodesulfurization in which gasoline boiling range petroleum feed and hydrogen are contacted in a reactor with a fixed bed hydrodesulfurization catalyst at an WHSV of greater than 6, pressure of less than 300 psig and temperature of 300 to 700° F. wherein the pressure and temperature of the reactor are adjusted to maintain the reaction effluent at its boiling point and below it dew point whereby at least a portion but less than all of the reaction mixture is vaporized.

23 Claims, 5 Drawing Sheets

HYDROGENATION PROCESS

This application claims the benefit of provisional application 60/114,331 filed Dec. 31, 1998.

BACKGROUND OF THE INVENTION

1. Field of the Invention

The present invention relates to an improved process for carrying out hydrogenations, in particular hydrodesulfurization in a catalyst bed.

2. Related Art

The most common method of removal of the sulfur compounds is by hydrodesulfurization (HDS) in which the petroleum feed is passed over a solid particulate catalyst comprising a hydrogenation metal supported on an alumina base. Additionally copious quantities of hydrogen are included in the feed. The following equations illustrate the reactions in a typical HDS unit:

(1) $RSH+H_2 \rightarrow RH+H_2S$ (2) $RCl+H_2 \rightarrow RH+HCl$ (3) $2RN+4H_2 \rightarrow RH+NH_3$ (4) $ROOH+2H_2 \rightarrow RH+H_2O$ Typical operating conditions for the HDS reactions are:

| | |
|---|---|
| Temperature, ° F. | 600–780 |
| Pressure, psig | 600–3000 |
| $H_2$ recycle rates, SCF/bbl | 1500–3000 |
| Fresh $H_2$ makeup, SCF/bbl | 700–1000 |

After the hydrotreating is complete, the product may be fractionated or simply flashed to release the hydrogen sulfide and collect the now desulfurized material. Olefinically unsaturated compounds may also be hydrogenated. The order of decreasing activity is:

diolefins mono olefins

Trickle bed reactors have been used in this service for more than thirty years. Generally the trickle bed reactors use a fixed catalyst bed having a hydrogenation metal catalyst in one or more layers through which the stream to be hydrogenated is passed with excess hydrogen. Most reactors are downflow with hydrogen either concurrentflow or counterflow to the petroleum feed stream. Depending on the process the petroleum feed to the reactor may be vaporous, liquid or mixed phase and the products may be vaporous, liquid or mixed phase. In all of these processes the commonality has been high pressure, i.e., in excess of 300 psig up to 3000 psig and long residence times.

The present invention maintains a liquid phase in the reaction zone and also provides a means for removing heat from the fixed continuous catalyst bed. A substantial portion of the sulfur is converted to $H_2S$ by hydrodesulfurization and is easily distilled away from the hydrocarbons. It is a further advantage that the present type of reaction may be used in conjunction with a catalytic distillation column reactor to obtain a very high degree of sulfur removal from the feed stream. These and other advantages will become apparent from the following descriptions.

SUMMARY OF THE INVENTION

The present invention is a process of hydrotreating petroleum feed comprising concurrently passing a petroleum feed containing organic sulfur compounds and hydrogen downflow through a reaction zone containing a hydrodesulfurization catalyst at a pressure of less than 300 psig pressure, preferably less than 275 psig, for example less than 200 psig, and for example at least about 100 psig at a temperature within the range of 300° F. to 700° F. to produce an effluent, said temperature and pressure being adjusted such that the temperature of the effluent is above its boiling point and below its dew point, whereby at least a portion but less than all of the material in said reaction zone is in the vapor phase and a portion of the organic sulfur compounds are converted to $H_2S$. Preferably the weight hourly space velocity (WHSV), i.e., the weight of petroleum feed per hour per volume of catalyst is greater than 6 $hr^{-1}$, preferably greater than 8 $hr^{-1}$ and more preferably greater than 15 $hr^{-1}$.

The reaction mixture (which includes the petroleum feed and the hydrotreated petroleum products), will have different boiling points at different pressures, hence the temperature in the reactor may be controlled by adjusting the pressure to the desired temperature within the recited range. The boiling point of the reaction mixture thus is the temperature of the reaction and the exothermic heat of reaction is dissipated by vaporization of the reaction mixture. The maximum temperature of any heated liquid composition will be the boiling point of the composition at a given pressure with additional heat merely causing more boilup. There must be liquid present, however, to provide the boil up, otherwise the temperature in the reactor will continue to rise which may damage the catalyst or cause coking. The temperature in the reaction zone is preferably not higher than the dew point of the reaction effluent, thus guaranteeing the presence of the liquid in the reaction. The feed to the reaction is preferably at least partially liquid phase.

To fully appreciate this aspect of the present invention, one must recognize that the petroleum feed, the reaction mixture and the reaction effluent form a very complex mixture of hydrocarbons, boiling over a range of temperatures and that similarly there is a range of dew points. Thus, the actual temperature of the reaction effluent (which is very similar in composition to that of the petroleum feed but having a reduced olefin content which also occurs during the sulfur compound removal) is the temperature at a given pressure at which some lower boiling components are vaporized, but at which some of the higher boiling components are not boiling, i.e., some higher boiling components are below their dew point. Therefore, in the present reaction system there are always two phases. It is believed that the presence of the liquid phase as described herein allows the lower pressures and shorter residence times (high space velocities).

The nature of some streams that are treated according to the present process is such that within the process operating variables, the steam is totally vaporized and thus the benefit of the invention is not obtained. In these cases a higher boiling petroleum component is added to the stream, i.e., the "target" stream to be treated and the conditions adjusted so as to vaporize whatever portion of the target stream is necessary to reduce the total sulfur content, while the higher boiling petroleum component provides the liquid component of the reaction system.

In a preferred embodiment the catalyst bed may be described as a fixed continuous bed, that is, the catalyst is loaded into the reactor in its particulate form to fill the reactor or reaction zone, although there may be one or more such continuous beds in a reactor, separated by spaces devoid of catalyst.

As used herein the term "distillation column reactor" means a distillation column which also contains catalysts such that reaction and distillation are going on concurrently in the column. In a preferred embodiment the catalyst is prepared as a distillation structure and serves as both the catalyst and distillation structure.

DETAILED DESCRIPTION OF THE INVENTION

Figure 1:
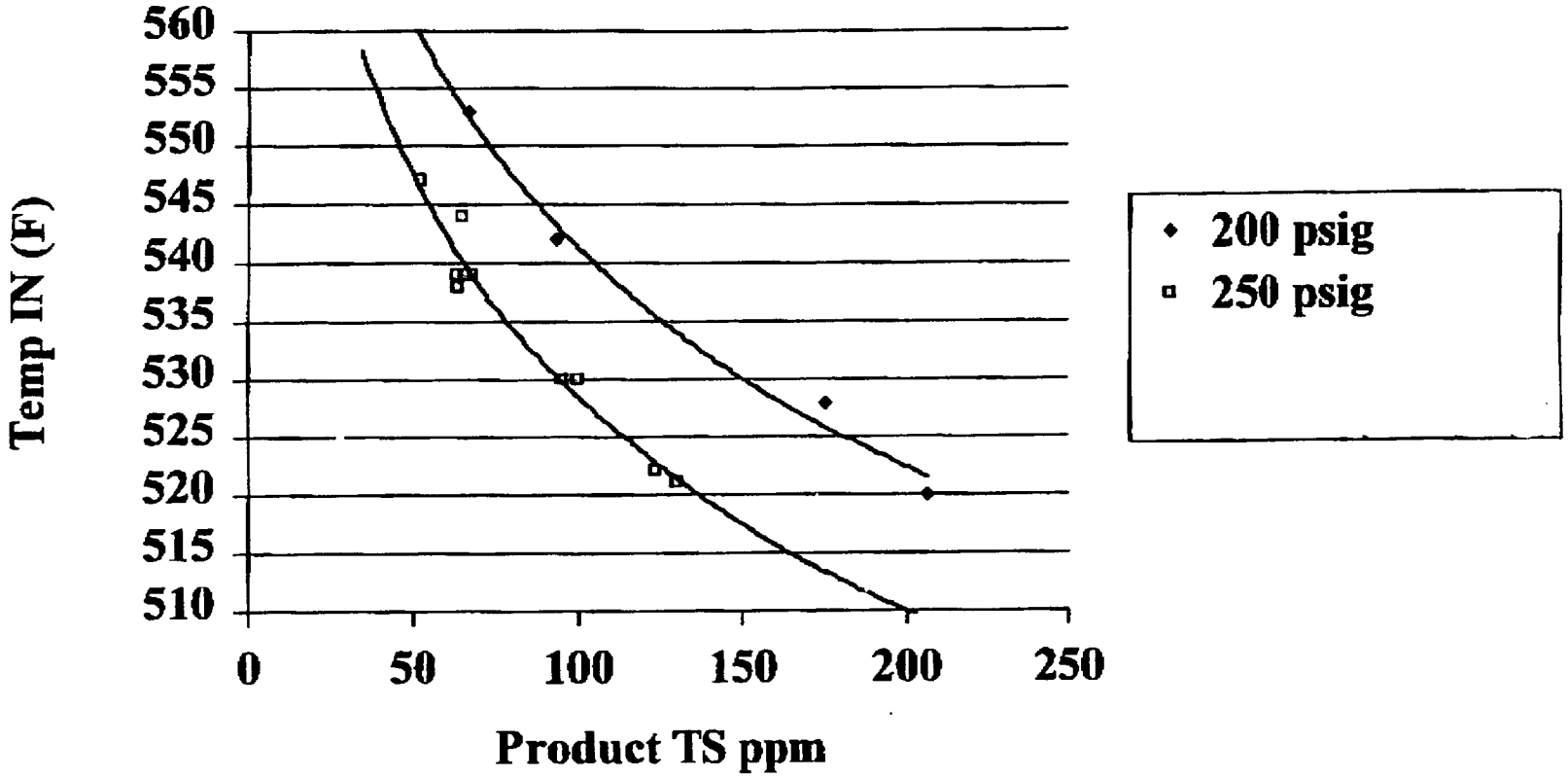
FIG. 1 is a graph showing the effect of pressure on sulfur removal.

Petroleum distillate streams are a preferred feed for the present process and contain a variety of organic chemical components. Generally the streams are defined by their boiling ranges which determine the compositions. The processing of the streams also affects the composition. For instance, products from either catalytic cracking or thermal cracking processes contain high concentrations of olefinic materials as well as saturated (alkanes) materials and polyunsaturated materials (diolefins). Additionally, these components may be any of the various isomers of the compounds. The petroleum distillates often contain unwanted contaminants such as sulfur and nitrogen compounds.

The feed to the present unit may comprise a single "full range naphtha" cut which may contain everything from $C_4$'s through $C_8$'s and higher. This mixture can easily contain 150 to 200 components. Mixed refinery streams often contain a broad spectrum of olefinic compounds. This is especially true of products from either catalytic cracking or thermal cracking processes.

The present feed may be a naphtha stream from either a crude distillation column or fluid catalytic cracking unit fractionated several times to obtain useful cuts. The full boiling range naphtha ($C_4$-430° F.) may first be debutanized to remove $C_4$ and lighter materials as overheads in a debutanizer, then depentanized to remove $C_5$ and lighter materials as overheads in a depentanizer (sometimes referred to as a stabilizer) and finally split into a light naphtha (110–250° F.) and a heavy naphtha (250–430°). Refinery streams separated by fractional distillation often contain compounds that are very close in boiling points, because such separations are not precise. A $C_5$ stream, for instance, may contain $C_4$'s and up to $C_8$'s. These components may be saturated (alkanes), unsaturated (monoolefins), or polyunsaturated (diolefins). Additionally, the components may be any or all of the various isomers of the individual compounds. Such streams typically contain 15 to 30 weight % of the isoamylenes.

Such refinery streams also contain small amounts of sulfur compounds which must be removed. The sulfur compounds are generally found in a cracked naphtha stream as mercaptans. Removal of sulfur compounds is generally termed "sweetening" a stream.

In one embodiment of the present invention, a higher boiling petroleum component such as gas oil is added to the reactor when the target petroleum fraction being treated is totally vaporized during the process. The higher boiling fraction may be substantially inert, that is it does not contain the mercaptans and serves only to provide boil up and a liquid phase in the reactor. However the added higher boiling petroleum fraction may itself be hydrotreated during the process. The higher boiling petroleum fraction may be separated from the target fraction and recycled to the reactor.

The temperature in the present reactor is conveniently controlled by the pressure used. The temperature in the reactor and catalyst bed is limited to the boiling point of the effluent at the pressure applied, notwithstanding the magnitude of the exotherm. A small exotherm may cause only a few percent of the liquid in the reactor to vaporize whereas a large exotherm may cause 30–90% of the liquids to vaporize. The temperature, however, is not dependent on the amount of material vaporized but the composition of the material being vaporized at a given pressure. That "excess" heat of reaction merely causes a greater boil up (vaporization) of the material present. The present process operates with an outlet pressure lower than the inlet pressure.

Preferably the bed is vertical with the feed passing downward through the bed and exiting after reaction through the lower end of the reactor. The reactor may be said to run in a quasi-isothermal manner.

Although the reaction is exothermic, it is necessary to initiate the reaction, e.g., by heating the feed to the reactor. In any event once the reaction is initiated, an exotherm develops and must be controlled to prevent a runaway reaction. The low pressures disclosed herein have the very great advantage of lower capital cost and operating cost than traditional processes. The reaction product in the present invention is at a higher temperature than the feed into the reactor with a portion being vapor and a portion liquid. The reactor is operated at a high weight hourly space velocity (6–30 $hr^{-1}$ WHSV, preferably 10–30 $hr^{-1}$, for example greater than 15 $hr^{-1}$) to avoid the reverse reaction (caused by the contact of the $H_2S$ formed in the hydrodesulfurization with the desulfurized materials). Olefins in gasoline are a factor in higher octane numbers, however they are also a cause of gum which form during storage and other octane improvers, which are not as detrimental as the olefins may be more desirable in some applications. If olefins are desirable in an application, the catalyst may be selected to have low selectivity to the olefins.

The product may be separated from the $H_2S$ by a flash or conventional distillation. However, a further embodiment of the present invention is the combination of the present reaction operated with a distillation column reactor as describe in U.S. Pat. Nos. 5,510,568 issued Apr. 23, 1996, U.S. Pat. No. 5,597,476 issued Jan. 28, 1997 and U.S. Pat. No. 5,779,883 issued Mar. 17,1997 which are incorporated herein in their entireties. This has the advantage of further reacting the residual sulfur compounds while fractionating the reaction product concurrently to produce even higher removal of sulfur. This combination has a further advantage in that both catalyst beds, i.e., the fixed partial liquid phase reactor of the present invention and the distillation column reactor can be relatively small compared to the use of either bed alone when used to obtain the same level of sulfur removal obtained by the combination. A higher boiling fraction may be maintained in the distillation column reactor as shown in U.S. Pat. No. 5,925,685 using an inert condensing component.

Catalysts which are useful for the hydrodesulfurization reaction include Group VIII metals such as cobalt, nickel, palladium, alone or in combination with other metals such as molybdenum or tungsten preferably on a suitable support which may be alumina, silica-alumina, titania-zirconia or the like. Normally the metals are provided as the oxides of the metals supported on extrudates or spheres in sizes of 1/32 to 1/4 inch and may be used herein. The smaller extrudates provide greater surface area, but at higher pressure drop through the reactor. The extrudate shapes may be any of those available, such as saddles, rings, polylobes and the like. The catalyst used in the following runs was a Calsicat Co/Mo hydrodesulfurization catalyst.

EXAMPLE 1

The hydrodesulfurization catalyst was contacted with a gasoline boiling range feed in a fixed bed reactor, which was operated to maintain a liquid phase in the reactor at all times and to remove a product stream of vapor and liquid. The feed contained 2250 ppm sulfur and had a bromine no. of 30. This feed was run under a variety of conditions with the result shown in FIGS. 1–5.

Figure 2:
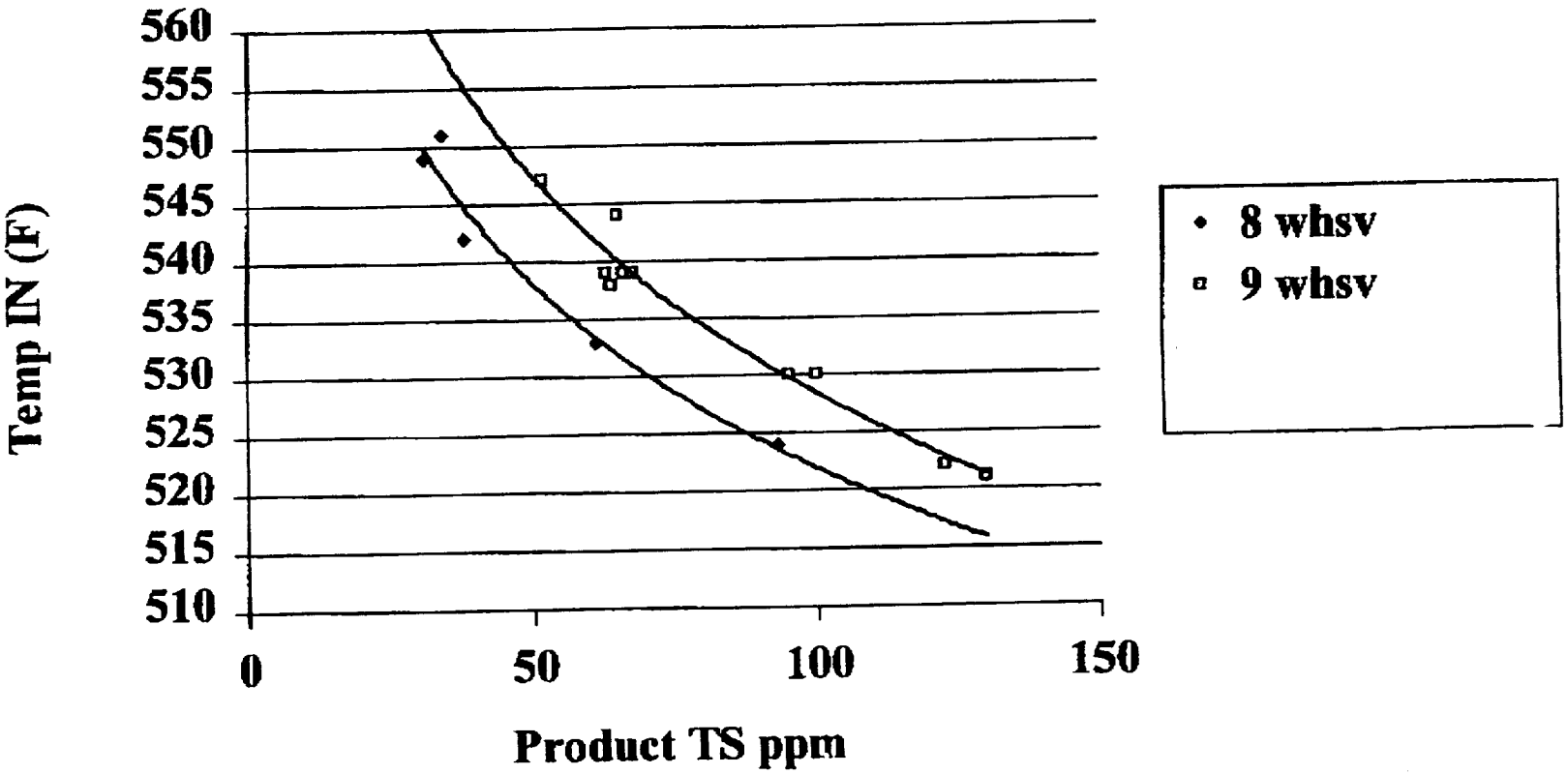
FIG. 2 is a graph showing the effect of WHSV on sulfur removal.
Figure 3:
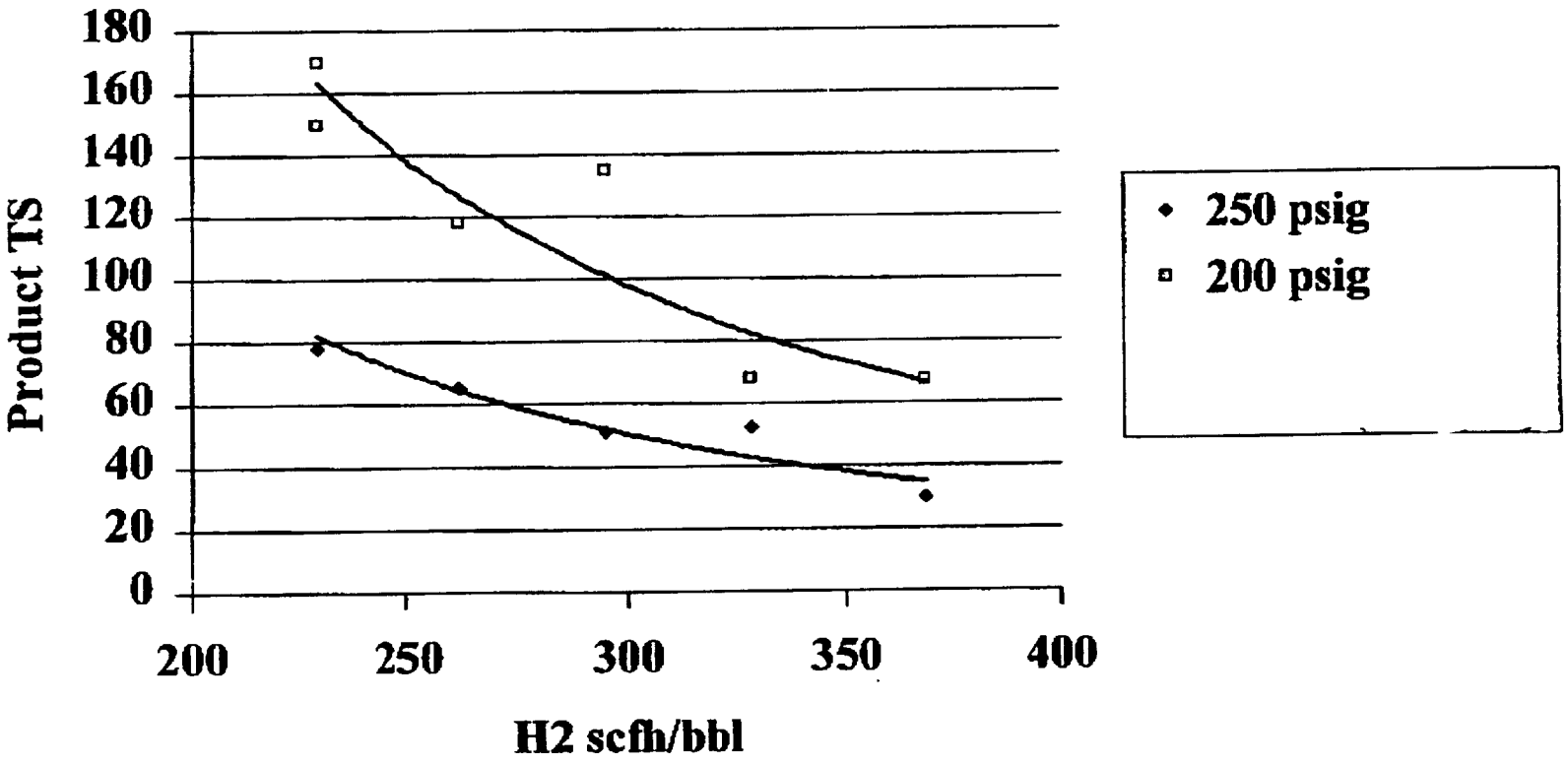
FIG. 3 is a graph showing the effect of hydrogen feed rate sulfur removal.
Figure 4:
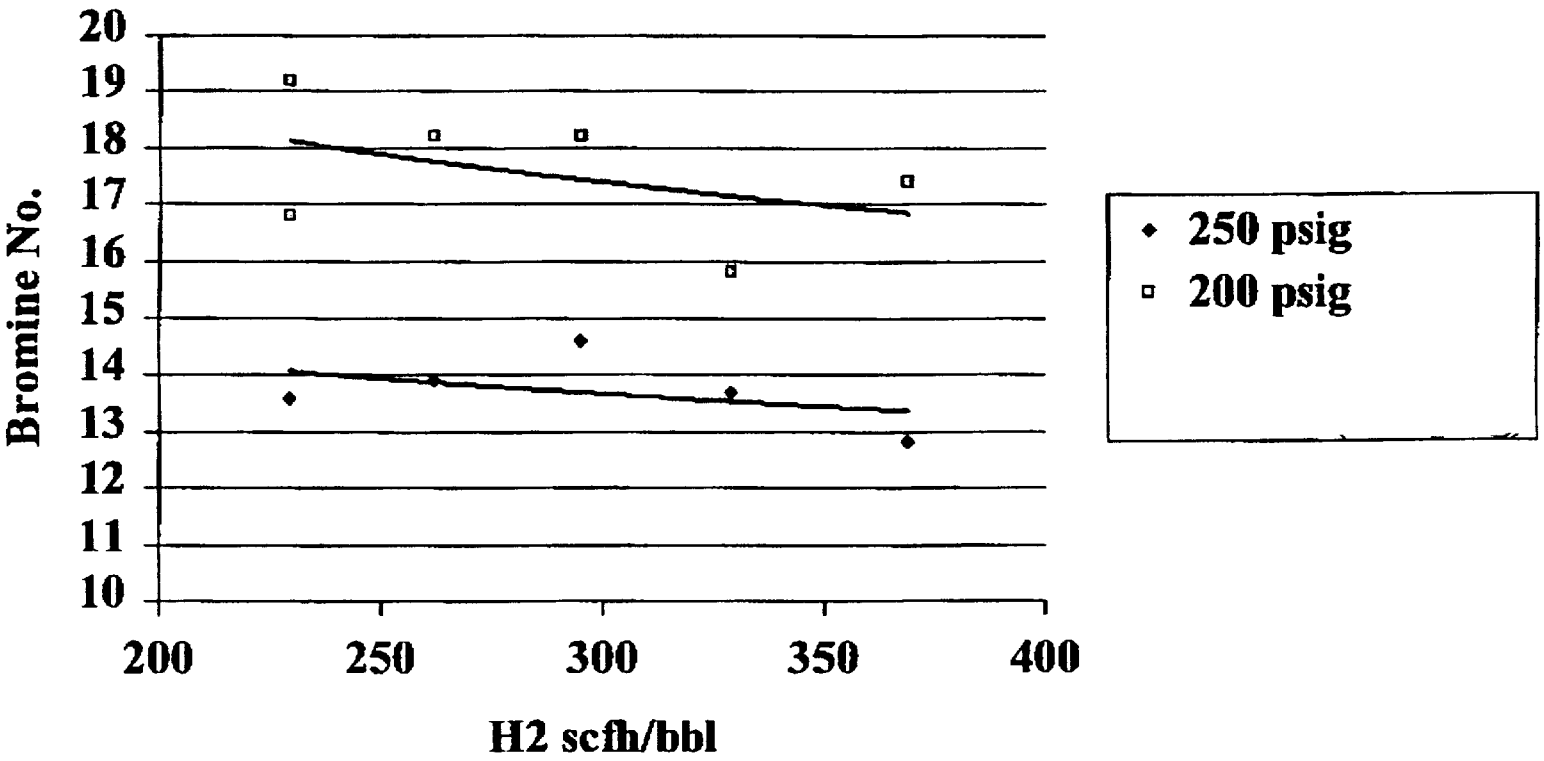
FIG. 4 is a graph showing the effect of hydrogen feed rate on olefin removal (bromine no.).
Figure 5:
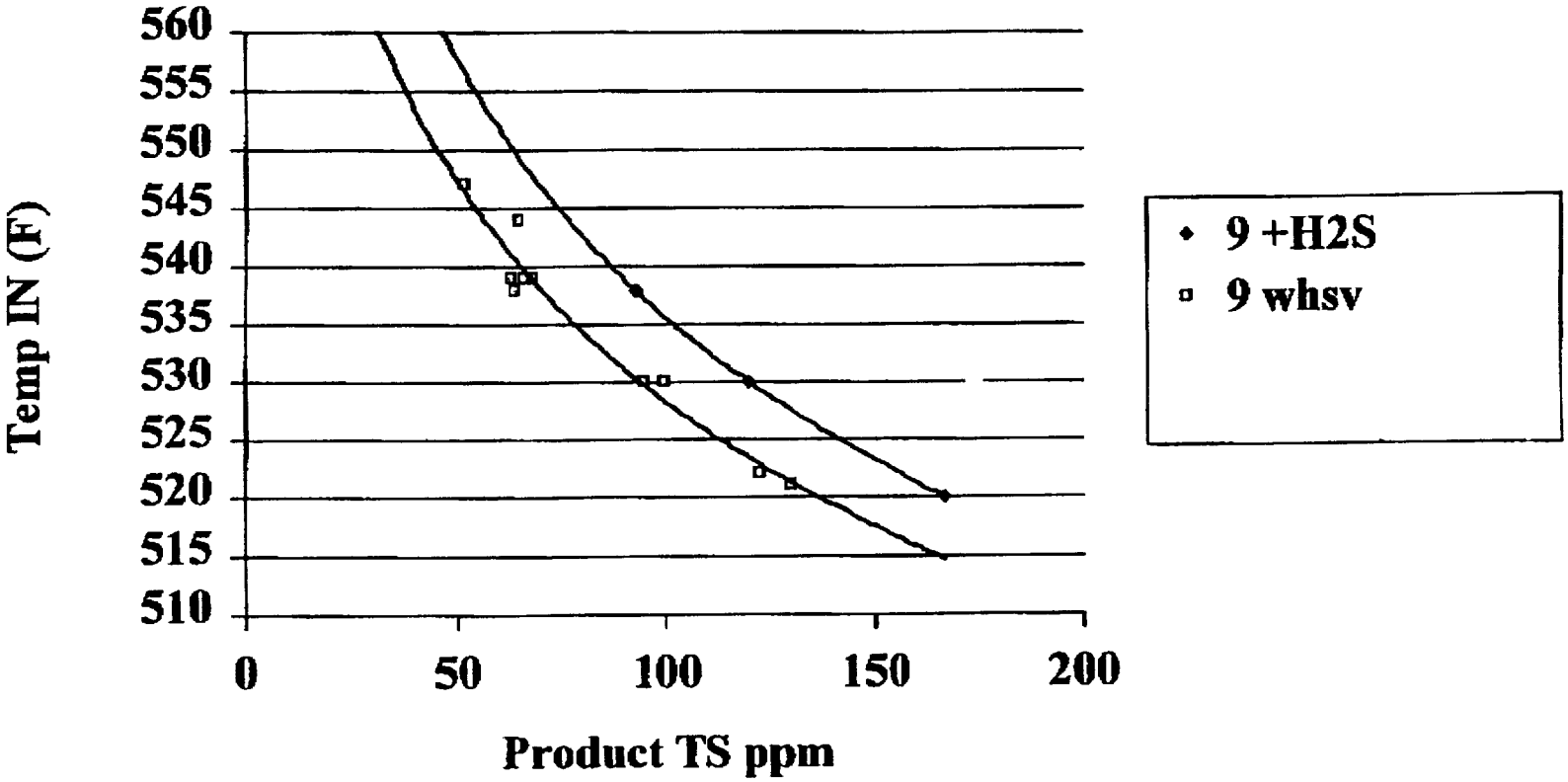
FIG. 5 is a graph showing the effect of $H_2S$ on sulfur removal.

The hydrogen flow rate for the runs shown in FIG. 1 was 370 scfhl/bbl and the WHSV was 9 $hr^{-1}$ at two different pressures to show the effect on total sulfur remaining in the products. In FIG. 2 the hydrogen flow rate was 370 scfh/bbl and the pressure 250 psig at two different WHSVs showing the effect on the total sulfur remaining in the products. In FIG. 3 the inlet temperature was 550° F. and the WHSV 9 $hr^{-1}$ with the hydrogen flow rate adjusted over a range of flow rates at two pressures showing the effect on total sulfur in the products. In FIG. 4 the inlet temperature was 550° F. and the WHSV 9 $hr^{-1}$ with the hydrogen flow rate adjusted over a range of flow rates at two pressures showing the effect on product bromine no. In FIG. 5 the hydrogen flow rate was 379 scfh/bbl at WHSV 9 $hr^{-1}$ with $H_2S$ at 3.3 scfhl/bbl added in one run showing the effect on the total sulfur in the products.

EXAMPLE 2

The same catalyst as used in Example 1 was used. The feed was a gasoline boiling range fraction containing 5000 ppm sulfur and having a bromine no. of 22. The gasoline and hydrogen were fed above the catalyst and flowed down. The conditions and results are shown below:

| | |
|---|---|
| Pounds of Catalyst | 10 |
| Gasoline Feed lbs/hr | 60 |
| $H_2$ scfh | 75 |
| Pressure psig | 200 |
| Bed temperature ° F. | 550–585 |
| Product Total Sulfur ppm | 27 |
| Product Bromine No. | 4.6 |

EXAMPLE 3

The same catalyst as used in Example 1 was used. The feed was a gasoline boiling range fraction containing 6500 ppm sulfur and having a bromine no. of 22. The gasoline and hydrogen were fed above the catalyst and flowed down. The conditions and results are shown below:

| | |
|---|---|
| Pounds of Catalyst | 10 |
| Gasoline Feed lbs/hr | 90 |
| $H_2$ scfh | 112.5 |

-continued

| | |
|---|---|
| Pressure psig | 250 |
| Bed temperature ° F. | 550–580 |
| Product Total Sulfur ppm | 117 |
| Product Bromine No. | 7.2 |

What is claimed is:

1. A process of hydrotreating petroleum feed comprising passing a petroleum feed containing organic sulfur compounds and hydrogen through a reaction zone containing a hydrodesulfurization catalyst at a pressure of less than 300 psig pressure at a temperature within the range of 300° F. to 700° F. to produce an effluent said temperature and pressure being adjusted such that the temperature of the effluent is above its boiling point and below its dew point, whereby at least a portion but less than all of the material in said reaction zone is in the vapor phase and a portion of the organic sulfur compounds are converted to $H_2S$.

2. The process according to claim 1 wherein said petroleum feed is a gasoline boiling range material.

3. The process according to claim 2 wherein the pressure in the reaction zone is less than 275 psig.

4. The process according to claim 3 wherein the pressure in the reaction zone is less than 200 psig.

5. The process according to claim 4 wherein the WHSV is greater than 6 $hr^{-1}$.

6. The process according to claim 5 wherein the WHSV is greater than 15 $hr^{-1}$.

7. The process according to claim 1 wherein the pressure in the reaction zone is at least 100 psig.

8. The process according to claim 1 wherein said hydrogenation catalyst comprises a Group VIII metal.

9. The process according to claim 1 wherein said effluent is treated in a distillation column reaction zone by contacting said effluent with hydrogen in the presence of a hydrodesulfurization catalyst wherein there is a concurrent reaction to form $H_2S$ and distillation of the treated effluent to recover a treated effluent having a reduced sulfur content.

10. The process according to claim 9 wherein said hydrogenation catalyst is prepared as distillation structure.

11. The process according to claim 1 wherein the said petroleum feed and hydrogen are passed concurrent downflow.

12. The process according to claim 1 wherein the effluent is recovered and further contacted with hydrogen in a reaction zone containing a hydrodesulfurization catalyst under conditions of concurrent reaction and distillation.

13. The process according to claim 1 wherein said petroleum feed comprises a target stream and a higher boiling component added thereto.

14. The process according to claim 1 wherein the petroleum feed is at least partially liquid phase.

15. The process according to claim 1 wherein said petroleum feed is totally vaporized during the process and that a higher boiling petroleum component than said petroleum feed is added to said process.

16. The process according to claim 15 wherein said higher boiling component comprises gas oil.

17. The process according to claim 15 wherein said higher boiling component does not contain the mercaptans and serves only to provide boil up and a liquid phase in the process.

18. The process according to claim 15 wherein said higher boiling component is separated from the target fraction and recycled to the process.

19. A process of hydrotreating a petroleum feed comprising passing hydrogen and a petroleum feed containing at least an organic sulfur compound or an unsaturated compound through a reaction zone containing a hydrotreating catalyst at a pressure of less than 300 psig pressure at a temperature within the range of 300° F. to 700° F. to produce an effluent said temperature and pressure being adjusted such that the temperature of the effluent is above its boiling point and below its dew point, whereby at least a portion but less than all of the material in said reaction zone is in the vapor phase and a portion of the organic sulfur compound is converted to $H_2S$ or a portion of the unsaturated compound is saturated.

20. The process according to claim 19 wherein the feed contains an organic sulfur compound and the catalyst is a hydrodesulfurization catalyst and a portion of the organic sulfur compounds are converted to $H_2S$.

21. The process according to claim 19 wherein the feed contains an unsaturated compound and the catalyst is a hydrogenation catalyst.

22. The process according to claim 19 wherein the feed contains olefins and the catalyst is a hydrogenation catalyst.

23. The process according to claim 19 wherein the feed contains organic sulfur compounds and olefins; the catalyst is a hydrotreating catalyst; a portion of the organic sulfur compounds are converted to $H_2S$ and a portion of the olefins are saturated.

* * * * *